US010400556B2

(12) United States Patent
Hazel

(10) Patent No.: US 10,400,556 B2
(45) Date of Patent: Sep. 3, 2019

(54) DOWNHOLE COMPLETION SYSTEM SEALING AGAINST THE CAP LAYER

(71) Applicant: Welltec Oilfield Solutions AG, Zug (CH)

(72) Inventor: Paul Hazel, Aberdeen (GB)

(73) Assignee: Welltec Oilfield Solutions AG, Zug (CH)

( * ) Notice: Subject to any disclaimer, the term of this patent is extended or adjusted under 35 U.S.C. 154(b) by 242 days.

(21) Appl. No.: 15/238,902

(22) Filed: Aug. 17, 2016

(65) Prior Publication Data

US 2017/0051585 A1 Feb. 23, 2017

(30) Foreign Application Priority Data

Aug. 17, 2015 (EP) ..... 15181310
Oct. 23, 2015 (EP) ..... 15191258

(51) Int. Cl.
*E21B 43/10* (2006.01)
*E21B 23/06* (2006.01)
(Continued)

(52) U.S. Cl.
CPC ..... *E21B 43/105* (2013.01); *E21B 23/01* (2013.01); *E21B 23/06* (2013.01); *E21B 33/127* (2013.01);
(Continued)

(58) Field of Classification Search
CPC ..... E21B 23/01; E21B 23/06; E21B 33/1208; E21B 33/127; E21B 33/1285;
(Continued)

(56) References Cited

U.S. PATENT DOCUMENTS 3,386,515 A * 6/1968 Crow ..... E21B 33/1208 166/120
4,962,815 A * 10/1990 Schultz ..... E21B 23/006 166/127
(Continued)

FOREIGN PATENT DOCUMENTS

EP 2 206 879 7/2010
EP 2206879 A1 * 7/2010 ..... E21B 33/1208
(Continued)

OTHER PUBLICATIONS

Extended Search Report for EP 15191258.1, dated Apr. 29, 2016, 7 pages.

*Primary Examiner* — Caroline N Butcher
(74) *Attorney, Agent, or Firm* — Nixon & Vanderhye P.C.

(57) ABSTRACT

A cementless downhole completion system including an annular barrier with a tubular metal part being mounted as part of a first well tubular metal structure arranged in a borehole in a formation and the annular barrier is arranged opposite an impermeable cap layer in the formation. A downhole completion system for completing a well having a top, comprising a formation comprising a cap layer, a borehole extending through the cap layer to provide an inner cap layer face and, a first well tubular metal structure arranged in the borehole comprising a first annular barrier and a second annular barrier. In the expanded position, the expandable tubular of the first annular barrier overlaps the cap layer and the expandable tubular of the second annular barrier overlaps the cap layer.

21 Claims, 9 Drawing Sheets

(51) Int. Cl.

| | |
|---|---|
| ***E21B 33/127*** | (2006.01) |
| ***E21B 23/01*** | (2006.01) |
| ***E21B 33/12*** | (2006.01) |
| ***E21B 33/128*** | (2006.01) |
| ***E21B 34/10*** | (2006.01) |
| ***E21B 47/026*** | (2006.01) |
| ***E21B 47/06*** | (2012.01) |

(52) U.S. Cl.
CPC ..... *E21B 33/1208* (2013.01); *E21B 33/1285* (2013.01); *E21B 34/10* (2013.01); *E21B 47/026* (2013.01); *E21B 47/06* (2013.01); *E21B 47/065* (2013.01)

(58) Field of Classification Search
CPC ..... E21B 34/10; E21B 43/105; E21B 47/026; E21B 47/06; E21B 47/065
See application file for complete search history.

(56) References Cited

U.S. PATENT DOCUMENTS

| | | | | |
|---|---|---|---|---|
| 6,157,893 | A * | 12/2000 | Berger | E21B 49/008 702/12 |
| 2013/0146285 | A1* | 6/2013 | Chhina | E21B 43/00 166/268 |
| 2015/0354351 | A1* | 12/2015 | Morrow | E21B 47/01 367/82 |

FOREIGN PATENT DOCUMENTS

| | | | | |
|---|---|---|---|---|
| EP | 2 599 956 | | 6/2013 | |
| EP | 2 728 111 | | 5/2014 | |
| EP | 2728111 | A1 * | 5/2014 | E21B 33/127 |
| EP | 2 853 681 | | 4/2015 | |

* cited by examiner

DOWNHOLE COMPLETION SYSTEM SEALING AGAINST THE CAP LAYER

This application claims priority to EP Patent Application Nos. 15181310.2 filed 17 Aug. 2015, and 15191258.1 filed 23 Oct. 2015, the entire contents of each of which are hereby incorporated by reference.

FIELD OF THE INVENTION

The present invention relates to a downhole completion system for completing a well. Furthermore, the present invention relates to a completion method for a downhole completion system.

BACKGROUND ART

Hydrocarbons in a reservoir are trapped by overlying rock formations with lower permeability functioning as a seal layer, also referred to as a cap layer or cap rock. Thus, in order to access the contents of the hydrocarbon-containing reservoir, it is usually necessary to drill through the seal layer if the reservoir is not just seeping and does not have such a seal layer. When completing a well, the first and upper part of the well is drilled, and the seal layer is then penetrated. Subsequently, the casing strings are run into the hole and are each sealed by cement pumped down through the casing shoe and further out of the bottom of the borehole and upwards into the annulus surrounding the casing to fill up the annulus between the casing and the borehole wall to create a seal. When pumping cement down the casing, corresponding to filling up the annulus to the required height, e.g. 200 meters, a cemented shoe-track is created at the bottom of the casing string. After some curing time, the cemented shoe-track is drilled out and the lower part of the well is completed by drilling into the reservoir. The cement is presumed to seal between the cap rock and the casing, but the cement cannot be tested by pressurisation from below the cement, since the pressurised fluid would leak out through the formation below the seal layer. Thus, whether or not the cement forms a proper seal against the cap rock cannot be tested before drilling further into the formation, opening the reservoir and thus releasing the reservoir pressure. Many types of cement, e.g. cement having radioactive particles, have been used in for testing the sealing property of the cement, but none of these attempts have been very successful. Therefore, today many wells are leaking because the cement does not seal sufficiently.

SUMMARY OF THE INVENTION

It is an object of the present invention to wholly or partly overcome the above disadvantages and drawbacks of the prior art. More specifically, it is an object to provide an improved completion system, wherein it is possible to test the sealing against the cap layer.

The above objects, together with numerous other objects, advantages and features, which will become evident from the below description, are accomplished by a solution in accordance with the present invention by a cementless downhole completion system comprising an annular barrier with a tubular metal part being mounted as part of a first well tubular metal structure arranged in a borehole in a formation, the annular barrier being arranged opposite an impermeable cap layer in the formation.

Furthermore, the present invention relates to a downhole completion system for completing a well having a top, comprising:

- a formation comprising:
  - an impermeable cap layer having an upper end and a lower end, and
  - a borehole extending through the cap layer to provide an inner cap layer face, and
- a first well tubular metal structure arranged in the borehole comprising:
  - a first annular barrier and a second annular barrier, each annular barrier comprising:
    - a tubular metal part, the tubular metal part being mounted as part of the first well tubular metal structure,
    - an expandable tubular surrounding the tubular metal part, each end section of the expandable tubular being connected with the tubular metal part,
    - an annular barrier space between the tubular metal part and the expandable tubular, and
    - an expansion opening in the tubular metal part through which pressurised fluid passes for expanding the expandable tubular and bringing the annular barrier from an unexpanded position to an expanded position, wherein the first annular barrier is arranged at the upper end of the cap layer, and in the expanded position, the expandable tubular of the first annular barrier overlaps the cap layer, and the second annular barrier is arranged at the lower end of the cap layer, and in the expanded position, the expandable tubular of the second annular barrier overlaps the cap layer.

Furthermore, the downhole completion system may be a cementless downhole completion system.

Moreover, the confined space may be cementless.

Also, the first well tubular metal structure may comprise a sensor unit configured to identify the impermeable cap layer.

In the expanded position, the first annular barrier, the second annular barrier, the first well tubular metal structure and the cap layer may enclose a confined space.

Furthermore, the cap layer may be an impermeable cap layer.

Moreover, the first well tubular metal structure may comprise a sensor unit arranged between the first annular barrier and the second annular barrier and being configured to measure a property of a fluid in the confined space.

Also, the sensor unit may be comprised in the first annular barrier or the second annular barrier.

The downhole completion system according to the present invention may further comprise a pressurisation device for pressurising the first well tubular metal structure.

Furthermore, the pressurisation device may be arranged at the top of the well tubular metal structure.

Additionally, the pressurisation device may be arranged in a tool inserted into the first well tubular metal structure.

In addition, the downhole completion system according to the present invention may further comprise one or more third annular barrier(s) arranged between the first annular barrier and the second annular barrier.

Further, the sensor unit may comprise a communication device configured to communicate sensor data.

The downhole completion system may further comprise a tool having a communication module adapted to receive the sensor data.

In addition, the expandable tubular may be an expandable metal tubular.

The expandable tubular may be made of strengthened elastomer, e.g. elastomer strengthened with metal.

Also, elastomeric seals may be arranged on an outside of the expandable tubular.

Moreover, the first annular barrier or the second annular barrier may comprise a valve device in fluid communication with the expansion opening.

Furthermore, the sensor unit may be connected with the valve device.

The valve device may have a first position in which fluid is allowed to flow from the first well tubular metal structure to the annular barrier space and a second position, thereby providing fluid communication between the annular barrier space and the confined space.

Further, the first annular barrier or the second annular barrier may comprise a plurality of sensor units.

The downhole completion system according to the present invention may further comprise a second well tubular metal structure extending at least partly within the first well tubular metal structure and extending below the cap layer.

Also, one of the annular barriers may be made solely from a metal material.

In addition, the sensor unit may comprise a pressure sensor or a temperature sensor.

Moreover, each annular barrier may comprise a plurality of sensors.

Also, the downhole completion system described above may further comprise a second well tubular metal structure being suspended from the first well tubular metal structure.

In addition, the second tubular metal structure may be a liner hanger.

The second well tubular metal structure may be suspended from the first well tubular metal structure.

Additionally, an annular barrier may be arranged between the first well tubular metal structure and the second well tubular metal structure.

Further, the second well tubular metal structure may comprise one or more annular barriers.

The present invention also relates to a completion method for a downhole completion system as described above, comprising:

identifying an impermeable cap layer, introducing the first well tubular metal structure into the borehole, arranging a first annular barrier and a second annular barrier at least partly opposite the impermeable cap layer so that an expandable tubular of the first annular barrier and the second annular barrier overlaps the impermeable cap layer, and expanding the expandable tubular of the first annular barrier and the second annular barrier to abut the impermeable cap layer to enclose a confined space.

The completion method according to the present invention may further comprise pressurising the confined space to a predetermined pressure.

In addition, the completion method according to the present invention may further comprise determining if the pressure in the confined space is kept substantially constant over a period of time to verify the sealing properties of at least one of the annular barriers against the cap layer.

Said method may also comprise determining the pressurisation performed by the sensor unit.

Also, the pressurisation may be performed from the top of the well.

Moreover, the pressurisation may be performed by means of a tool inserted into the first well tubular metal structure.

Furthermore, the completion method according to the present invention may comprise shifting a valve device of one of the annular barriers from a first position providing fluid communication from an inside of the first well tubular metal structure to the annular barrier space to a second position providing fluid communication between the annular barrier space and the confined space.

Also, the confined space may be cementless.

The present invention furthermore relates to a completion method for a downhole completion system, comprising: identifying an impermeable cap layer, introducing the first well tubular metal structure into the borehole, and arranging a first annular barrier at least partly opposite the impermeable cap layer so that an expandable tubular of the first annular barrier overlaps the impermeable cap layer.

Finally, identifying the impermeable cap layer may be performed by a sensor unit of the first well tubular metal structure.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
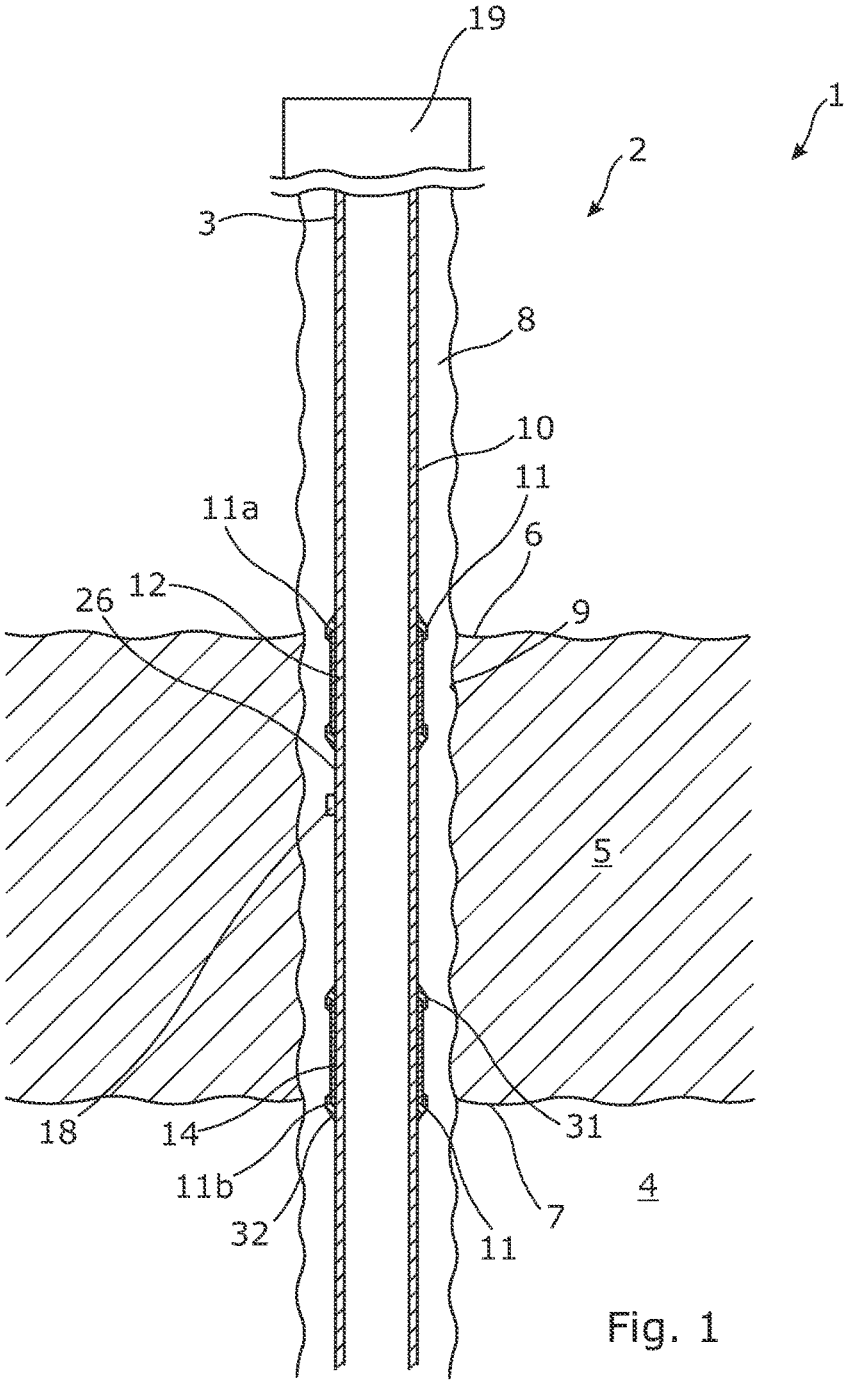
FIG. 1 shows a partly cross-sectional view of a downhole completion system having unexpanded annular barriers.

FIG. 1 shows a downhole completion system 1 for completing a well 2 in a formation 4 comprising hydrocarbon-containing fluid, such as crude oil and/or gas. The formation has a cap layer 5 having an upper end 6 and a lower end 7 and being substantially impermeable, preventing the hydrocarbon-containing fluid from emerging from/flowing upwards from the reservoir before a borehole 8 is drilled in the formation and extends through the cap layer. The cap layer is also called the seal or cap rock which is a section/unit with very low permeability that impedes the escape of the hydrocarbon-containing fluid from the reservoir in the formation, and the cap layer is thus defined as an impermeable layer providing a cap/closure of the formation. Common cap layers or seals include evaporates (sedimentary rocks), chalks and shales. The cap layer thus seals off the reservoir until a borehole is drilled.

Figure 2:
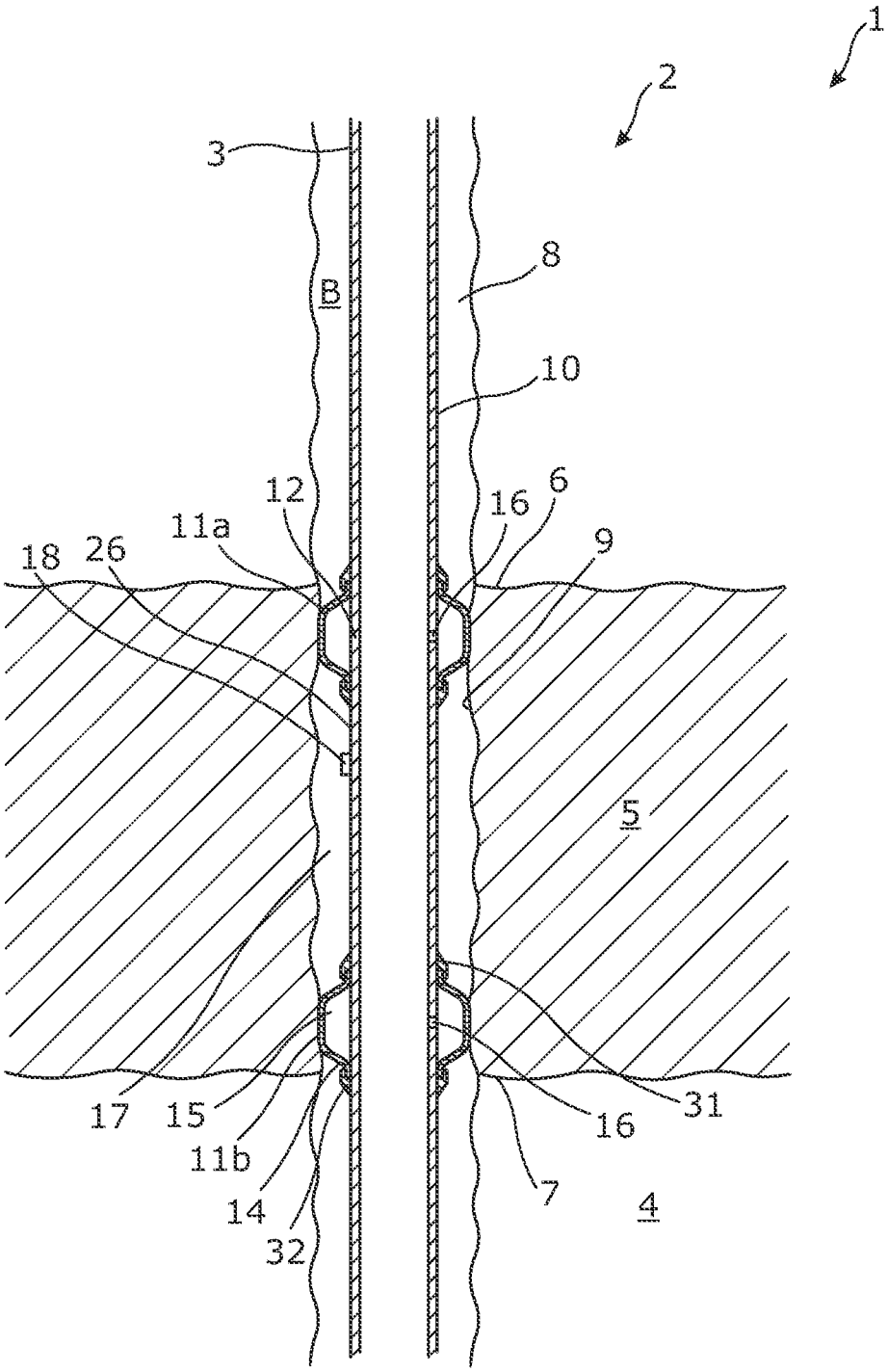
FIG. 2 shows the downhole completion system of FIG. 1 having expanded annular barriers.

The drilled borehole provides an inner cap layer face 9 of the cap layer 5. The downhole completion system 1 further comprises a first well tubular metal structure 10 arranged in the borehole. The downhole completion system 1 comprises a first annular barrier 11, 11*a* and a second annular barrier 11, 11*b*. Each annular barrier comprises a tubular part being a tubular metal part 12 which is mounted as part of the first well tubular metal structure and an expandable tubular 14 surrounding the tubular metal part. Each end section 31, 32 of the expandable tubular is connected with the tubular metal part, defining an annular barrier space 15 (shown in FIG. 2) between the tubular metal part and the expandable tubular. The tubular metal part comprises an expansion opening 16 (shown in FIG. 2) through which pressurised fluid passes for expanding the expandable tubular and bringing the annular barrier from an unexpanded position, as shown in FIG. 1, to an expanded position, as shown in FIG. 2. In the expanded position, the expandable tubular abuts the inner cap layer face, so that the first annular barrier is arranged at the upper end of the cap layer, and the expandable tubular of the first annular barrier overlaps the cap layer, and so that the second annular barrier is arranged at the lower end of the cap layer, and the expandable tubular of the second annular barrier overlaps the cap layer. Thus, in the expanded position, the first annular barrier, the second annular barrier, the first well tubular metal structure and the cap layer enclose a confined space 17. When the first annular barrier and/or the second annular barrier has/have been expanded, they form part of the main barrier, so that the hydrocarbon-containing fluid from the reservoir can only flow up through the inside of the first well tubular metal structure when drilling further into the formation and the reservoir opening up the reservoir. Thus, there is no need for using cement when the annular barriers overlap the impermeable cap layer, and the downhole completion system 1 is thus a cementless downhole completion system 1.

By having two annular barriers, the confined space can be tested to confirm that no cement is needed for providing the main barrier. Furthermore, by testing if the confined space can maintain a certain pressure, the main barrier provided by the annular barriers can be tested, which is not possible in the known solutions using cement.

The first well tubular metal structure has an outer face 26 on which a sensor unit 18 is arranged between the first annular barrier and the second annular barrier, as shown in FIGS. 1 and 2. The sensor unit 18 is configured to measure a property of a fluid in the confined space to verify that the first annular barrier and the second annular barrier isolate the confined space and thus confirm that the first annular barrier and the second annular barrier provide the main barrier against the cap layer. Thus, by means of the present downhole completion system, testing of the seal between the cap layer and the well tubular metal structure is possible. Such testing has not been possible in prior art solutions. In prior art solutions, the cap layer is covered with cement so that the pressurised test fluid pumped down the well tubular metal structure leaks out into the permeable formation below the cap layer, and thus, it is not possible to test whether it is the cement or the test fluid leaking into the permeable part of the formation. Furthermore, cement tends to deteriorate when subjected to fluid and temperature fluctuations, especially if the fluid can enter pores in the cement layer and be trapped in the cement. Then, as the temperature rises and falls, the fluid creates micro-bores in the cement.

Figure 3:
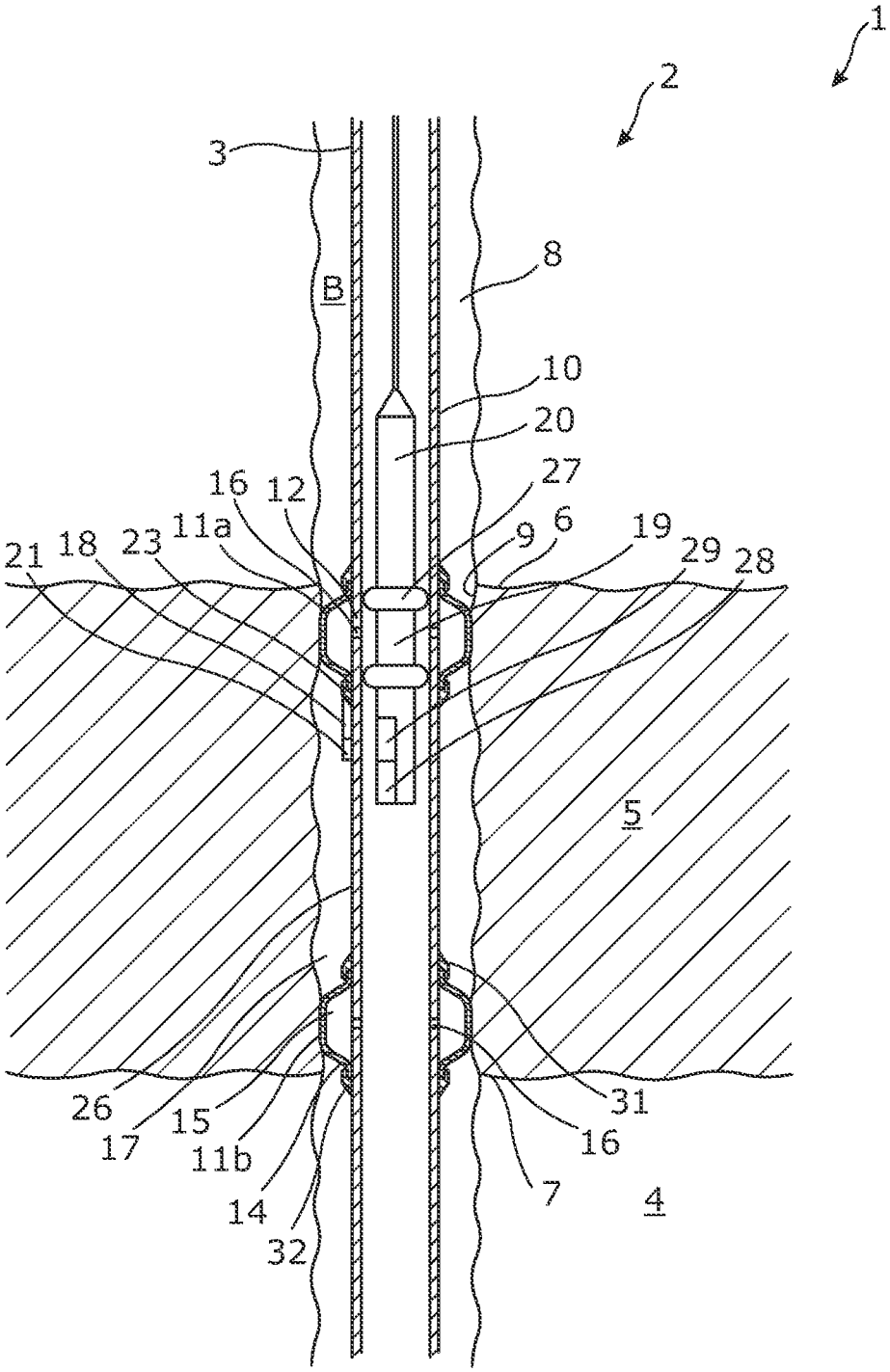
FIG. 3 shows a partly cross-sectional view of another downhole completion system having a tool for expansion of the annular barriers.
Figure 4:
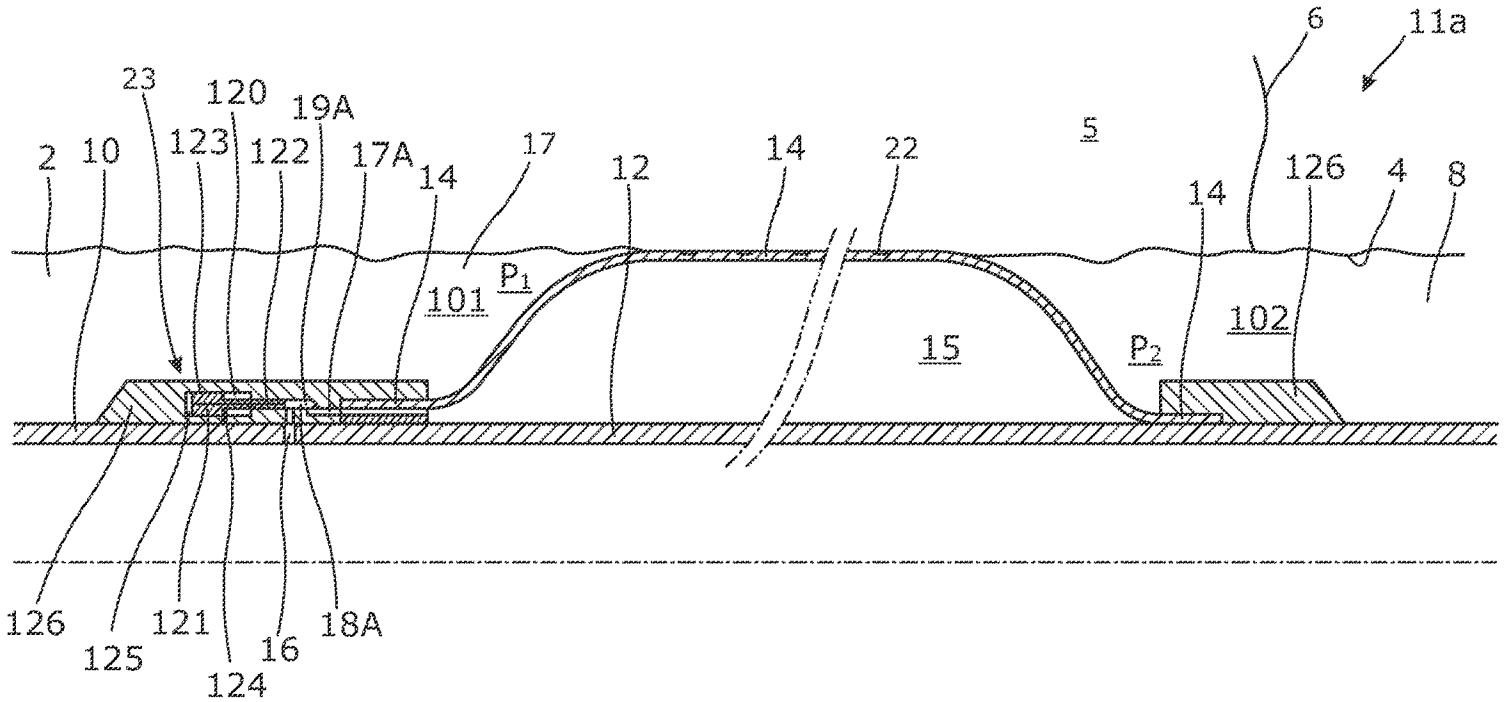
FIG. 4 shows an annular barrier having a valve device.
Figure 4A:
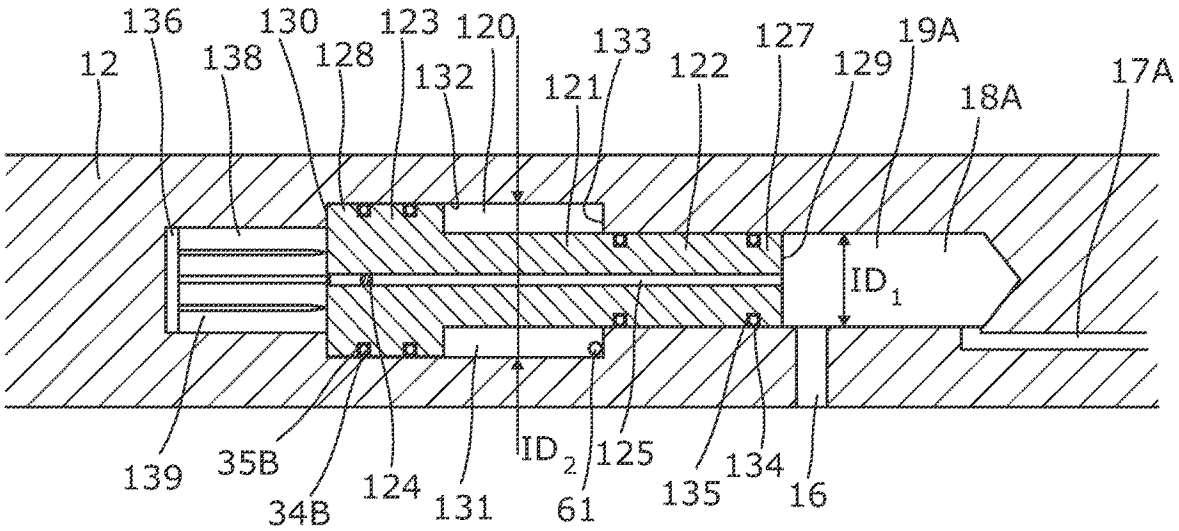
FIG. 4A shows a cross-sectional view of part of a valve device of an annular barrier having a bore with a piston in an initial position.
Figure 4B:
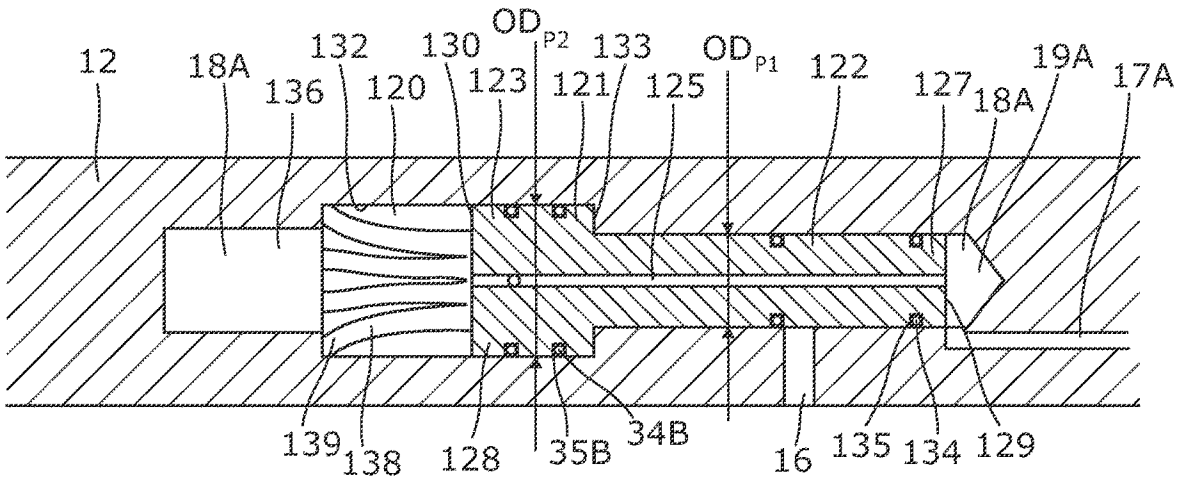
FIG. 4B shows the piston of FIG. 4A in its closed position.
Figure 5A:
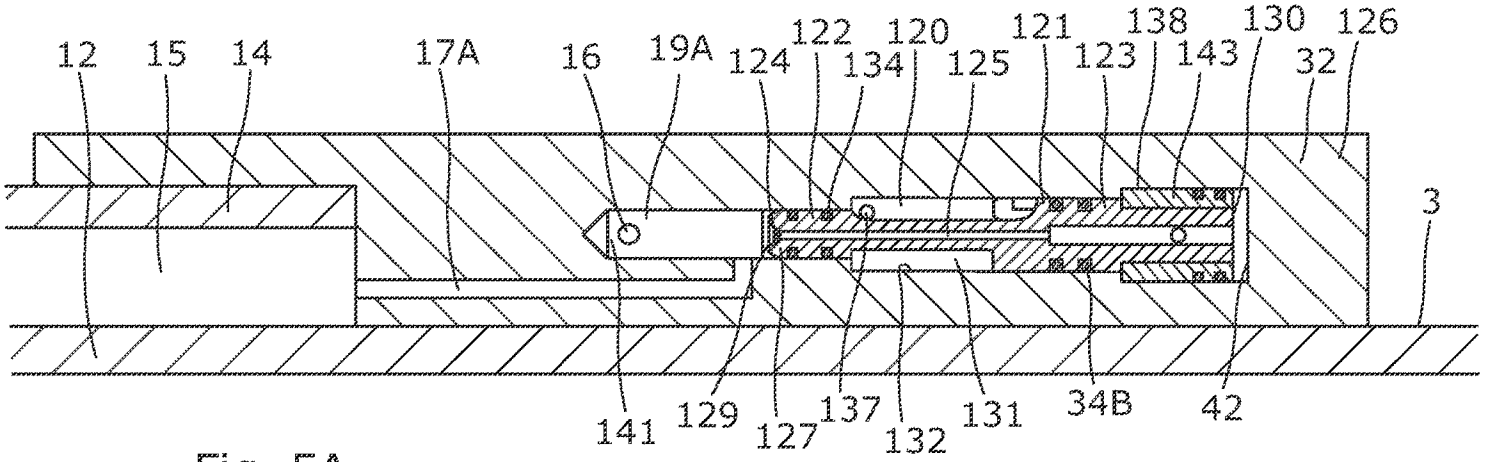
FIG. 5A shows another embodiment of the valve device having a piston in its initial position.
Figure 5B:
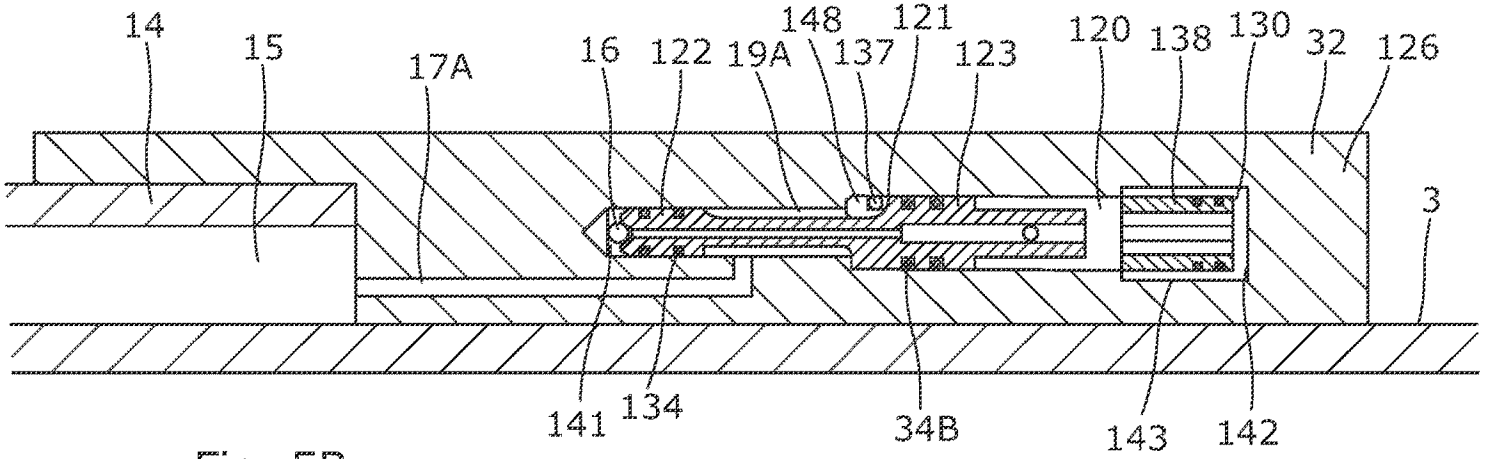
FIG. 5B shows the piston of FIG. 5A in its closed position.
Figure 6:
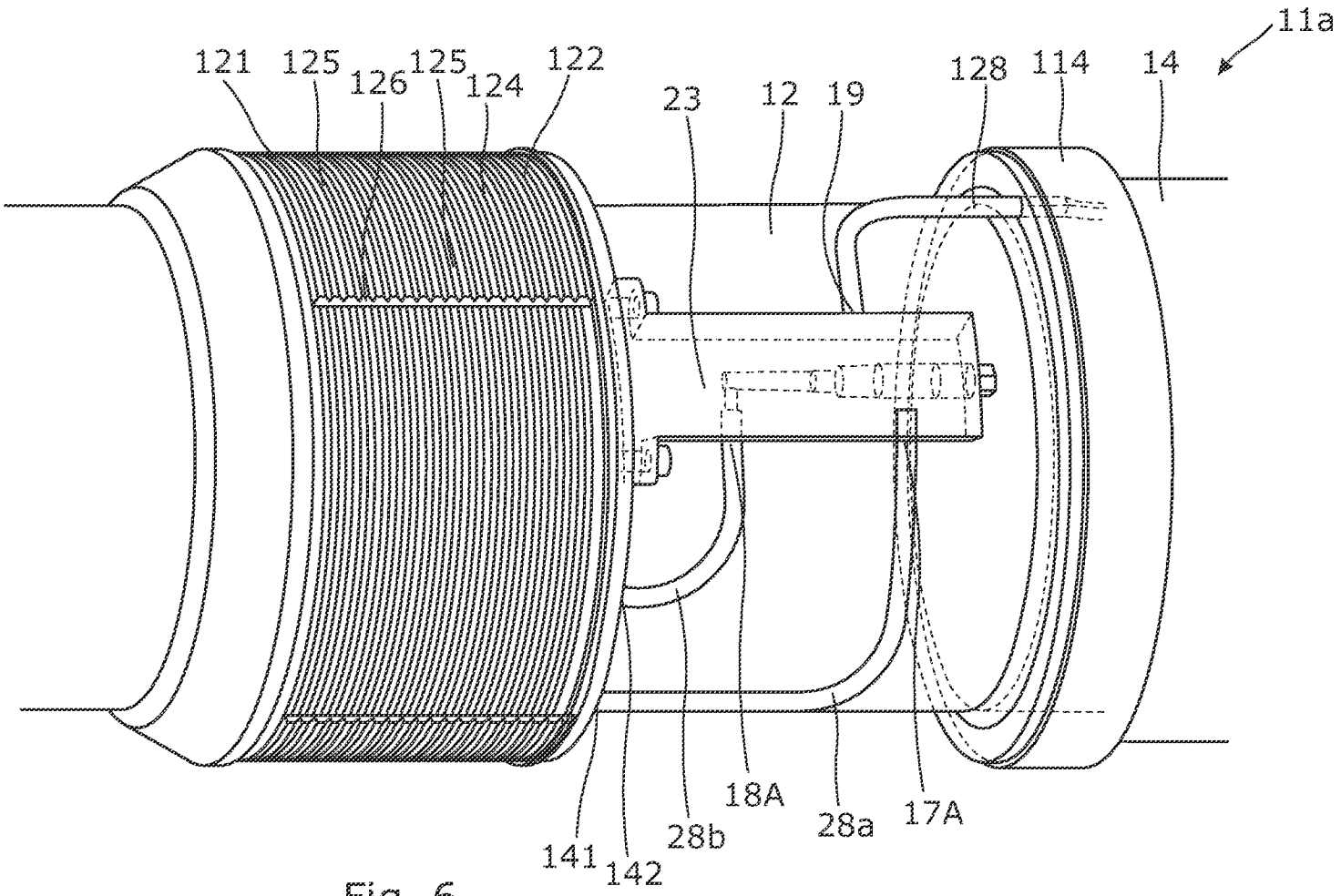
FIG. 6 shows a perspective view of part of an annular barrier.

In FIG. 3, the sensor unit 18 is comprised in the first annular barrier and arranged in the confined space 17. The downhole completion system further comprises a pressurisation device 19 for pressurising the inside of the first well tubular metal structure and thus expanding the annular barriers by letting pressurised fluid in through the expansion opening 16 and into the annular barrier space 15. The first annular barrier further comprises a valve device 23 in fluid communication with the expansion opening 16, as shown in FIGS. 4 and 6. The valve device has a first position, in which fluid is allowed to flow from the first well tubular metal structure to the annular barrier space, as shown in FIGS. 4A and 5A, and a second position, providing fluid communication between the annular barrier space and the confined space, as shown in FIGS. 4B and 5B. In FIG. 3, the sensor unit is connected with the valve device and forms part of the first annular barrier.

When having such a valve device, the fluid pressure in the confined space is equalised with the pressure in the annular barrier space during temperature fluctuations, and thus, by having a valve device in fluid communication with the confined space, no fracturing or leaking will occur during such temperature fluctuations.

In FIG. 1, the pressurisation device is arranged at the top of the well tubular metal structure, and in FIG. 3, the pressurisation device is arranged in a tool 20 inserted into the first well tubular metal structure. The tool comprises isolation means for isolating a part of the first well tubular metal structure opposite the expansion opening 16 for pressurising the annular barrier space 15.

The annular barrier has a first opening 16, i.e. the expansion opening 16, in fluid communication with the inside of the first well tubular metal structure and a second opening 17A in fluid communication with the annular barrier space 15, as shown in FIG. 4. When the inside of the tubular metal part is pressurised, fluid flows into the annular barrier space 15, expanding the expandable tubular 14 to the expanded position, as shown in FIG. 2.

As shown in FIG. 4, the annular barrier further comprises a bore 18A having a bore extension and comprising a first bore part 19A having a first inner diameter $ID_1$, as shown in FIG. 4A, and a second bore part 120 having an inner diameter $ID_2$, as shown in FIG. 4A, which is larger than that of the first bore part. The first opening 16 and the second opening 17A are arranged in the first bore part and are displaced along the bore extension. The annular barrier further comprises a piston 121 arranged in the bore. As shown in FIG. 4B, the piston comprises a first piston part 122 having an outer diameter $OD_{P1}$ substantially corresponding to the inner diameter of the first bore part 19A and comprising a second piston part 123 having an outer diameter $OD_{P2}$ substantially corresponding to the inner diameter of the second bore part 120. As shown in FIG. 4A, the annular barrier further comprises a rupture element 124 preventing movement of the piston until a predetermined pressure in the bore is reached. The piston comprises a fluid channel 125 being a through-bore providing fluid communication between the first bore part and the second bore part.

By having a piston with a fluid channel, fluid communication between the first bore part and the second bore part is provided so that upon rupture of the rupture element, the piston can move, resulting in fluid communication to the inside of the tubular metal part being closed off. In this way, a simple solution without further fluid channels is provided, and due to the fact that the second piston part has an outer diameter which is larger than that of the first piston part, the surface area onto which fluid pressure is applied is larger than that of the first piston part, and thus, the pressure moves the piston when the annular barrier is expanded and pressure has been built up for breaking the rupture element 124, which allows the piston to move. The annular space 131 is fluidly connected with the borehole via a hole 61, shown in FIG. 4A, and the pressure in the annular space can thus be relieved.

In FIGS. 5A and 5B, the rupture element is a shear disc, and in FIGS. 4A and 4B, the rupture element is a shear pin. Depending on the isolation solution required to provide isolation downhole, the rupture element is selected so that the rupture element breaks at a pressure higher than the expansion pressure but lower than the pressure rupturing the expandable tubular or jeopardising the function of other completion components downhole. In FIGS. 5A and 5B, the bore and the piston 121 are arranged in a connection part 126 connecting the expandable tubular 14 with the tubular metal part 12. In FIGS. 4A and 4B, the bore and piston are arranged in the tubular metal part 12.

In FIGS. 4A and 4B, the piston has a first piston end 127 at the first piston part 122 and a second piston end 128 at the second piston part 123, the first piston end having a first piston face 129 and the second piston end having a second piston face 130, and the second piston face having a face area which is larger than a face area of the first piston face in order to move the piston towards the first bore end. The difference in face areas creates a difference in the force acting on the piston, causing the piston to move to close off the fluid communication between the first opening 16 and the second opening 17A.

As shown in FIG. 4A, the first piston part 122 extends partly into the second bore part 120 in an initial position of the piston and forms an annular space 131 between the piston and an inner wall 132 of the bore. Upon movement of the piston when the fluid presses onto the second face area of the second piston face 130, the piston movement is stopped when the second piston part reaches the first bore part, so that the second piston part rests against an annular face 133 created by the difference in inner diameter of the first and the second bore parts, which is shown in FIG. 4B. The annular space 131 is fluidly connected with ambient fluid and is thus pressure-relieved via a hole 61, thus allowing movement of the piston.

In FIGS. 4A and 4B, the annular barrier further comprises a locking element 138 adapted to mechanically lock the piston when the piston is in the closed position, blocking the first opening, as shown in FIG. 4B.

In FIG. 4A, the second piston part comprises the locking element arranged in the second piston end of the piston, the locking element being springy elements 139 projecting outwards but being suppressed in a third bore part 136 when the piston is in the initial position, and the springy elements are released when the piston moves to block the first opening, and the springy elements thus project radially outwards, as shown in FIG. 4B. Thus, the locking element is collets forming in the second piston end of the piston. The second bore part 120 is arranged between the first bore part and the second bore part, and the third bore part has an inner diameter which is larger than the inner diameter of the second bore part.

When using a mechanical lock preventing backwards movement of the piston, there is no need for a check valve to prevent the return of the piston when the pressure inside the annular barrier increases. In this way, the risk of dirt preventing closure of the check valve and the risk that a pressure increase in the annular space of the barrier forces the piston to return and provide fluid communication from the inside of the tubular metal part again is thus eliminated.

In the known solutions using check valves, the expandable tubular has a potential risk of breaking or rupturing when the formation is fracked with colder fluid, such as seawater. By permanently blocking the fluid communication between the annular space and the inside of the well tubular structure, the expandable tubular will not undergo such large changes in temperature and pressure, and thus, the risk of rupturing is substantially reduced.

In FIG. 5A, the annular barrier comprises a locking element 138 which is arranged around the second piston part 123. The bore further comprises a third opening 137 in the second bore part 120, which third opening is in fluid communication with the annular barrier space 15 and the annulus or borehole.

In FIG. 3, the sensor unit comprises a communication device 21 configured to communicate sensor data to another communication unit further up the well or to a communication module 28 in the tool shown in FIG. 3, adapted to receive the sensor data.

Figure 7:
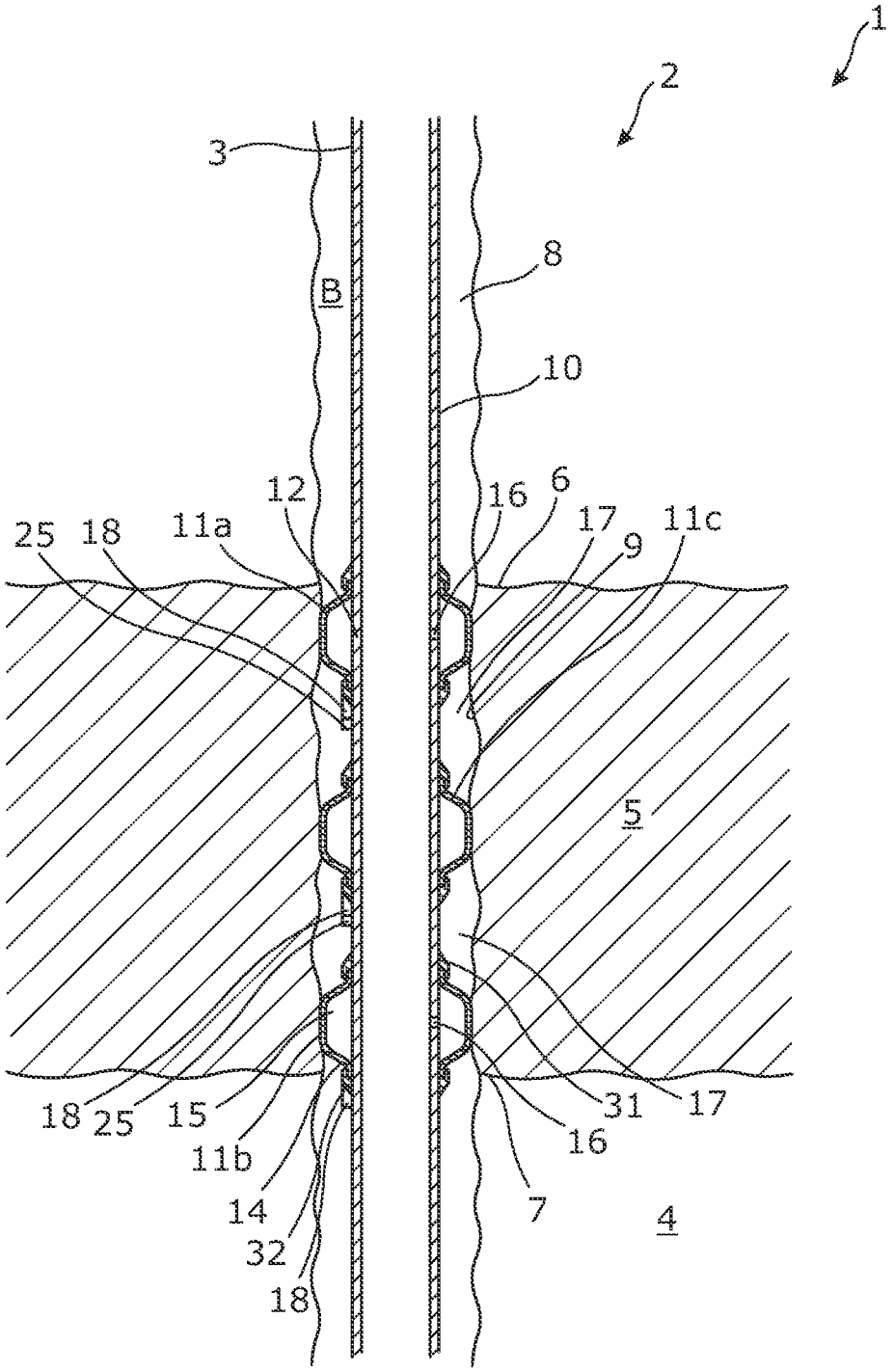
FIG. 7 shows a partly cross-sectional view of a downhole completion system having three annular barriers.

As shown in FIG. 7, the downhole completion system may further comprise one or more third annular barrier(s) 11*c* arranged between the first annular barrier 11*a* and the second annular barrier 11*b*. Each annular barrier comprises a sensor unit 18 so that the confined space 17 between the first annular barrier 11*a* and the third annular barrier 11*c* can be tested to verify the sealing properties of the first annular barrier from below, which would also be the direction in which the hydrocarbon-containing fluid from the reservoir would apply pressure onto the annular barrier. Also, the confined space 17 between the third annular barrier 11*c* and the second annular barrier 11*b* can be tested from below to verify that the third annular barrier has sufficient sealing properties. By having a third sensor unit below the second annular barrier, the sealing abilities of the second annular barrier may also be verified. The annular space above the first annular barrier is called the B-annulus B, and this is normally not pressurised during production but may be tested during completion of the well and later on.

As shown in FIG. 4, the first annular barrier may comprise elastomeric seals 22 on an outside of the expandable tubular. And in FIG. 7, the second and third annular barriers 11*b*, 11*c* are made solely of metal and have no sealing elements on the outer face of the expandable tubular.

In another embodiment, the downhole completion system comprises at least one annular barrier made solely of metal, preferably only annular barriers made solely of metal, so that a metal-to-rock seal is established between the well tubular metal structure and the cap layer. When having a metal-to-rock seal, the downhole completion system is prepared for plug and abandonment (P&A), and the well can easily be abandoned without having to enter the B-annulus to also fill that with cement to abandon the well, since the seal-to-cap rock is a metal-to-rock seal and thus approved for abandonment, e.g. the well is to be plugged for eternity, which is usually stated as 1,000 years according to general P&A requirements.

Figure 8:
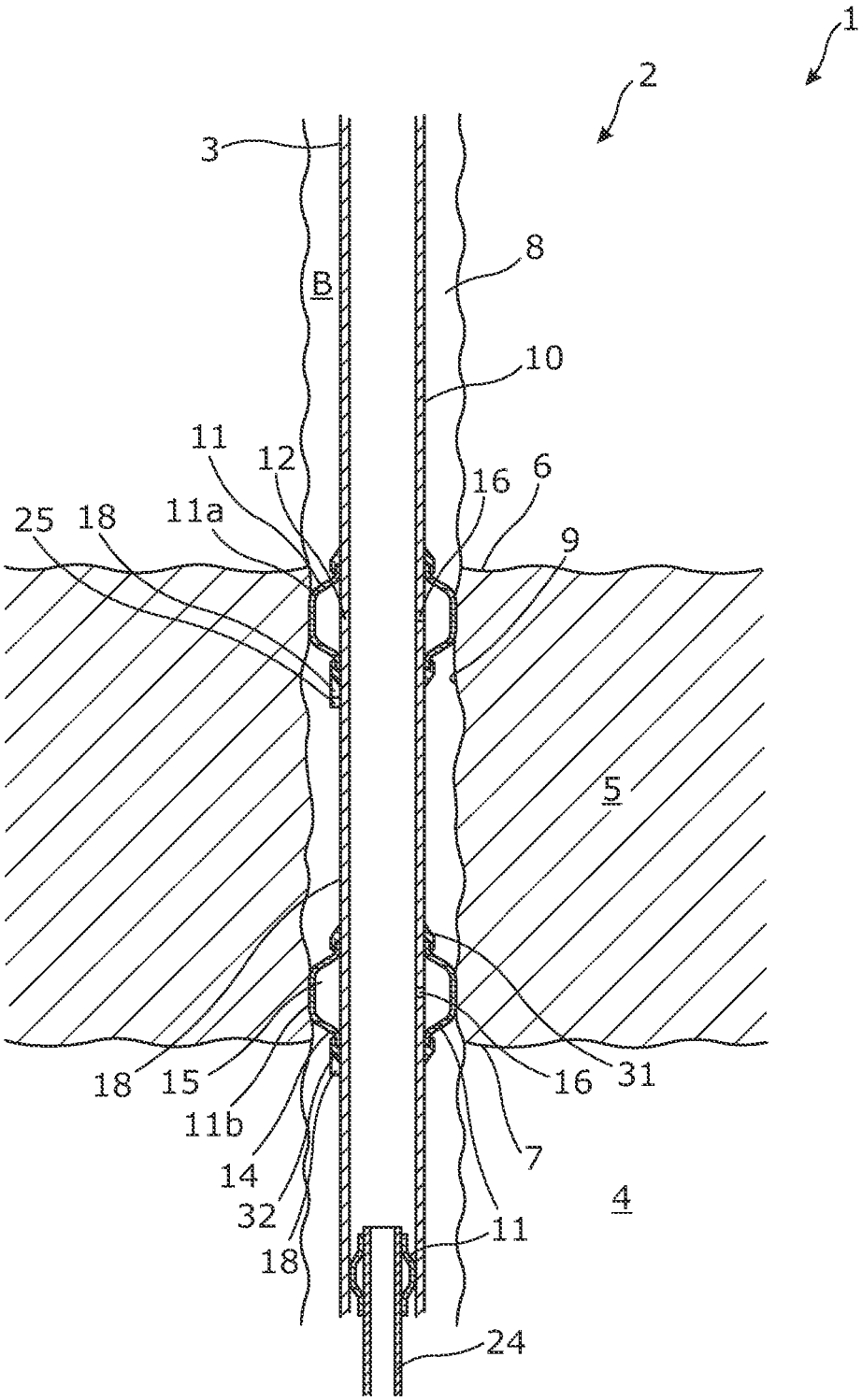
FIG. 8 shows a partly cross-sectional view of a downhole completion system having a second well tubular metal structure.

In FIG. 8, the downhole completion system further comprises a second well tubular metal structure 24 extending at least partly within the first well tubular metal structure and extending below the cap layer. The second well tubular metal structure 24 is suspended from the first well tubular metal structure and may also be called a liner hanger or a production casing. The second well tubular metal structure 24 extends into the reservoir for producing hydrocarbon-containing fluid and is connected with the first well tubular metal structure by means of an annular barrier or another packer. The second well tubular metal structure may comprise one or more annular barriers.

The sensor unit comprises a sensor 25, such as a pressure sensor, a temperature sensor or similar sensors. One sensor unit may comprise a plurality of sensors. The sensors may be different types of sensors so as to measure different properties of the confined space or the fluid in it.

In order to complete the well, a borehole is drilled down through the cap layer and the extent of the cap layer is identified. Then, the first well tubular metal structure is submerged and introduced into the borehole, and the first annular barrier and the second annular barrier are arranged at least partly opposite the cap layer, so that the expandable tubular of the first annular barrier and the second annular barrier overlaps the cap layer. Subsequently, the expandable tubular of the first annular barrier and the second annular barrier is expanded to abut the inner cap layer face to enclose a confined space and provide the main barrier of the completion. Then, the confined space is pressurised to a predetermined pressure by means of the valve device shifting position from a first position providing fluid communication from an inside of the first well tubular metal structure to the annular barrier space to a second position providing fluid communication between the annular barrier space and the confined space. Thus, the annular barrier space equalises its pressure with the confined space, and the pressure in the confined space is monitored to watch if it is kept substantially constant over a period of time to verify the sealing properties of at least one of the annular barriers against the cap layer. The pressure in the confined space is determined and monitored by the sensor unit. The pressurisation is performed from the top of the well or by means of a tool inserted into the first well tubular metal structure. First, the expandable tubular is expanded, and then, the confined space is pressurised.

A stroking tool may be used for pressurising an isolated zone opposite the expansion opening. The stroking tool is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a well tubular metal structure, casing, liner or production casing is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole completion system for completing a well through a top formation having an impermeable top cap layer having an upper end and a lower end, the impermeable top cap layer being positioned above a hydrocarbon-containing reservoir, and a borehole extending through the cap layer to provide an inner cap layer face, the system comprising a first well tubular metal structure configured to be arranged in the borehole, the first well tubular metal structure comprising:

a first annular barrier and a second annular barrier, each annular barrier comprising:

a tubular metal part, the tubular metal part being mounted as part of the first well tubular metal structure, an expandable tubular surrounding the tubular metal part, each end section of the expandable tubular being connected with the tubular metal part, an annular barrier space between the tubular metal part and the expandable tubular, and an expansion opening in the tubular metal part through which pressurised fluid is configured to pass for expanding the expandable tubular and bringing the annular barrier from an unexpanded position to an expanded position, wherein the first annular barrier is configured and arranged to be positioned at the upper end of the cap layer, and in the expanded position, the expandable tubular of the first annular barrier overlaps the cap layer, and the second annular barrier is configured and arranged to be positioned at the lower end of the cap layer, and in the expanded position, the expandable tubular of the second annular barrier overlaps the cap layer to create a confined space between the first and second annular barriers.

2. The downhole completion system according to claim 1, wherein the downhole completion system is a cementless downhole completion system.

3. The completion system according to claim 1, wherein the confined space is cementless.

4. The downhole completion system according to claim 1, wherein the first well tubular metal structure comprises a sensor unit configured to identify the impermeable cap layer.

5. The downhole completion system according to claim 1, wherein in the expanded position, the first annular barrier, the second annular barrier, the first well tubular metal structure and the cap layer are configured to enclose the confined space.

6. The downhole completion system according to claim 1, wherein the first well tubular metal structure comprises a sensor unit arranged between the first annular barrier and the second annular barrier and being configured to measure a property of a fluid in the confined space.

7. The downhole completion system according to claim 6, wherein the sensor unit is comprised in the first annular barrier or the second annular barrier.

8. The downhole completion system according to claim 6, wherein the sensor unit comprises a communication device configured to communicate sensor data.

9. The downhole completion system according to claim 6, wherein the sensor unit comprises a pressure sensor or a temperature sensor.

10. The downhole completion system according to claim 1, further comprising a pressurisation device for pressurising the first well tubular metal structure.

11. The downhole completion system according to claim 1, further comprising one or more third annular barrier(s) arranged between the first annular barrier and the second annular barrier.

12. The downhole completion system according to claim 1, wherein the first annular barrier or the second annular barrier comprises a valve device in fluid communication with the expansion opening.

13. The downhole completion system according to claim 1, further comprising a second well tubular metal structure extending at least partly within the first well tubular metal structure and adapted to extend below the cap layer.

14. The downhole completion system according to claim 1, wherein one of the first or second annular barriers is made solely from a metal material.

15. The downhole completion system according to claim 1, further comprising a second well tubular metal structure being suspended from the first well tubular metal structure.

16. The downhole completion system according to claim 15, wherein the second well tubular metal structure is a liner hanger.

17. A completion method for a downhole completion system comprising:

identifying an impermeable top cap layer positioned above a hydrocarbon-containing reservoir, introducing the first well tubular metal structure into the borehole, arranging a first annular barrier and a second annular barrier at least partly opposite the impermeable cap layer so that an expandable tubular of each of the first annular barrier and the second annular barrier overlaps the impermeable cap layer, and expanding the expandable tubular of the first annular barrier and the second annular barrier to abut the impermeable cap layer to enclose a confined space between the first and second annular barriers.

18. The completion method according to claim 17, further comprising pressurising the confined space to a predetermined pressure.

19. The completion method according to claim 17, further comprising determining if pressure in the confined space is kept substantially constant over a period of time to verify the sealing properties of at least one of the annular barriers against the cap layer.

20. The completion method according to claim 17, further comprising shifting a valve device of one of the first or second annular barriers from a first position providing fluid communication from an inside of the first well tubular metal structure to an annular barrier space to a second position providing fluid communication between the annular barrier space and the confined space.

21. The completion method according to claim 17, wherein the confined space is cementless.

* * * * *